United States Patent [19]

Tsuruta et al.

[11] Patent Number: 4,699,118

[45] Date of Patent: Oct. 13, 1987

[54] APPARATUS FOR DRESSING CUTTING EDGE

[75] Inventors: Shoji Tsuruta, Noda; Hideaki Minami, Kasukabe; Yoshinori Ohhata; Shinsuke Sakai, both of Noda, all of Japan

[73] Assignees: Mitsubishi Kinzoku Kabushiki Kaisha; Japan Silicon Co., Ltd., both of Tokyo, Japan

[21] Appl. No.: 841,094

[22] Filed: Mar. 18, 1986

[30] Foreign Application Priority Data

Mar. 29, 1985 [JP] Japan ..... 60-66176

[51] Int. Cl.[4] ..... B24B 53/00

[52] U.S. Cl. ..... 125/11 R; 51/145 R; 51/246

[58] Field of Search ..... 125/11 R; 51/145 R, 51/246, 325

[56] References Cited

U.S. PATENT DOCUMENTS

| | | | |
|---|---|---|---|
| 1,675,183 | 6/1928 | Loeffler | 51/145 R |
| 2,728,176 | 12/1955 | Ritzert | 51/246 |
| 3,350,818 | 11/1967 | Clark | 51/246 |
| 3,381,765 | 5/1968 | Weisel | 125/11 R |
| 4,237,852 | 12/1980 | Wiener | 125/11 R |
| 4,347,689 | 9/1982 | Hammond | 51/145 R |

FOREIGN PATENT DOCUMENTS

| | | | |
|---|---|---|---|
| 5755014 | 11/1980 | Japan . | |
| 57-144663 | 9/1982 | Japan . | |
| 30667 | 2/1984 | Japan | 125/11 R |
| 256370 | 8/1926 | United Kingdom | 51/145 R |
| 256422 | 8/1926 | United Kingdom | 51/246 |

*Primary Examiner*—Harold D. Whitehead

*Attorney, Agent, or Firm*—Cushman, Darby & Cushman

[57] ABSTRACT

A dressing apparatus comprises a head movably mounted on a tip portion of a body, the head having a tip having formed therein a cut-out which opens in the direction of the movement of the head and into which one of outer and inner peripheral cutting edges formed on a cut-off wheel in the form of a disc is adapted to be inserted, a tape traveling device mounted on the head and the body for causing a tape having a layer of abrasive grain on a side thereof to travel across the cut-out in the head, and an actuator disposed between the head and the body for moving the head. The dressing apparatus and a dressing method are arranged such that the one peripheral cutting edge is inserted into the cut-out in the head, and the one peripheral cutting edge and the side of the tape are brought into contact with each other while causing the tape to travel by the tape traveling device, to apply the dressing to the one peripheral cutting edge.

4 Claims, 5 Drawing Figures

C
controller
28
2
2c
22a
22
22a
12
11
17
13
14
10
27
23
24
21
26
22

APPARATUS FOR DRESSING CUTTING EDGE

BACKGROUND OF THE INVENTION

1. Field of the Invention

The present invention relates to a method of and an apparatus for applying a dressing to a cut-off wheel of a cutting machine and, more particularly, to dressing method and apparatus for use in the dressing of an outer or an inner peripheral cutting edge of the cut-off wheel in the form of a disc.

2. Related Art Statement

In the cutting of a semiconductor material such as a silicon ingot, for example, into slices to produce semiconductor wafers, a cut-off wheel having an inner peripheral cutting edge is generally utilized. As shown in FIG. 1 of the accompanying drawings, the cut-off wheel W is in the form of a disc having formed at a center thereof an opening 1, and an inner peripheral cutting edge 2 consisting of an electrically deposited diamond layer of the like is formed along an entire peripheral edge portion of the opening 1. The cut-off wheel W is mounted on a cutting machine (not shown) by means of attaching openings 3 formed along an outer peripheral portion of the cut-off wheel W and is rotated at a high speed by the cutting machine, to cause the inner peripheral cutting edge 2 to successively cut, into the form of a slice, a silicon ingot 4 which is inserted in the opening 1 and is moved in parallel to the cut-off wheel W, as indicated by arrows A.

Such cut-off wheel W decreases in cutting performance due to loading, wear or the like of the inner peripheral cutting edge 2 as the number of cutting operations increases. The decrease in cutting performances causes a variation in thickness and a warp or curvature of the cut products to occur, and this results in the deterioration in quality of the wafers which are final products. Accordingly, it is necessary for such cut-off wheel W to suitably apply a so-called dressing to the inner peripheral cutting edge 2 to remove the loading therefrom and to cause chipping to occur therein, to thereby regenerate or rejuvenate a sharp cutting edge. Conventionally, as the dressing of the inner peripheral cutting edge 2, a dressing method has been adopted in which the inner peripheral cutting edge of the cut-off wheel is caused to cut a highly hard material such as a GC grindstone, a WA grindstone or the like in substitution for the silicon ingot 4 which is a work piece to be cut.

In addition, in general, the warp is caused to occur due to the fact that peripheral side edge portions 2*a* and 2*b* (only the side edge portion 2*a* is shown in FIG. 1) adjacent an end face 2*c* of the edge 2 are different in cutting resistance from each other and, therefore, the edge 2 is curved and bites in the ingot 4 to cut the same. In order to reduce the warp, a method has also been adopted in which the dressing is selectively applied only to one of the peripheral side edge portions 2*a* and 2*b* which is high in cutting resistance, i. e., low in cutting efficiency.

However, it is required for the above-described conventional dressing method to once interrupt the cutting of the silicon ingot 4 by means of the inner peripheral cutting edge 2 at each dressing operation, and this results in a disadvantage of reduction in operating efficiency. Consequently, such problems have arisen that it is difficult to continously obtain products which are uniform in thickness, and the number of inappropriate dressings inevitably increases, to thereby result in the reduction in service life of the inner peripheral cutting edge 2.

Moreover, a large variation or change in warp results in a large variation in the thickness of the products and, accordingly, the above-described selective dressing of the one peripheral side edge portion is required to be performed in such a manner that a slight dressing is successively applied to the one side edge portion at each cutting cycle. It is troublesome to perform such operation manually, and an automatization has been desired. However, an appropriate method of repeatedly supplying a dressing material over a great number of cycles has not yet been proposed, and the automatization has been difficult.

SUMMARY OF THE INVENTION

According to the invention, there is provided an apparatus for applying a dressing to one of outer and inner peripheral cutting edges formed on a disc-shaped cut-off wheel mounted on a cutting machine for rotating the cut-off wheel, the dressing apparatus comprising a body mounted on the cutting machine; a head movably mounted on the body, the head having a tip having formed therein a cut-out which opens in the direction of the movement of the head into which one of the outer and inner peripheral cutting edges is inserted; a flexible tape having a layer of abrasive grain on a side thereof, the tape being mounted on the head and the body so as to be capable of being traveled; tape traveling means mounted on the head and the body for causing the tape to travel across the cut-out in the head; and actuator means disposed between the head and the body for moving the head relative to the one peripheral cutting edge, so that the side of the tape is brought into contact with the one peripheral cutting edge.

DESCRIPTION OF THE PREFERRED EMBODIMENTS OF THE INVENTION

Figure 2:
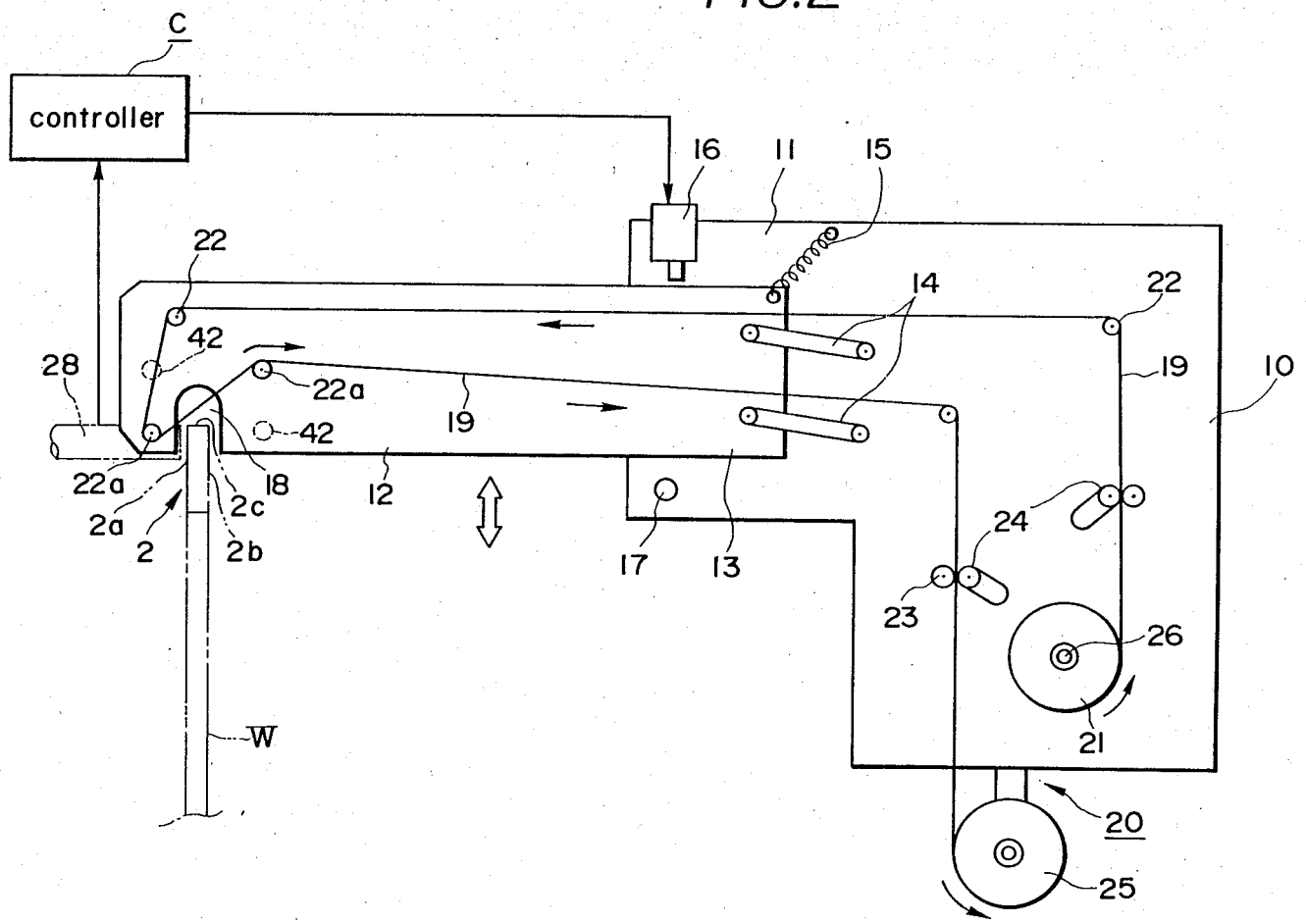
FIG. 2 is diagrammatic front elevational view showing a dressing apparatus in accordance with an embodiment of the present invention.
Figure 3:
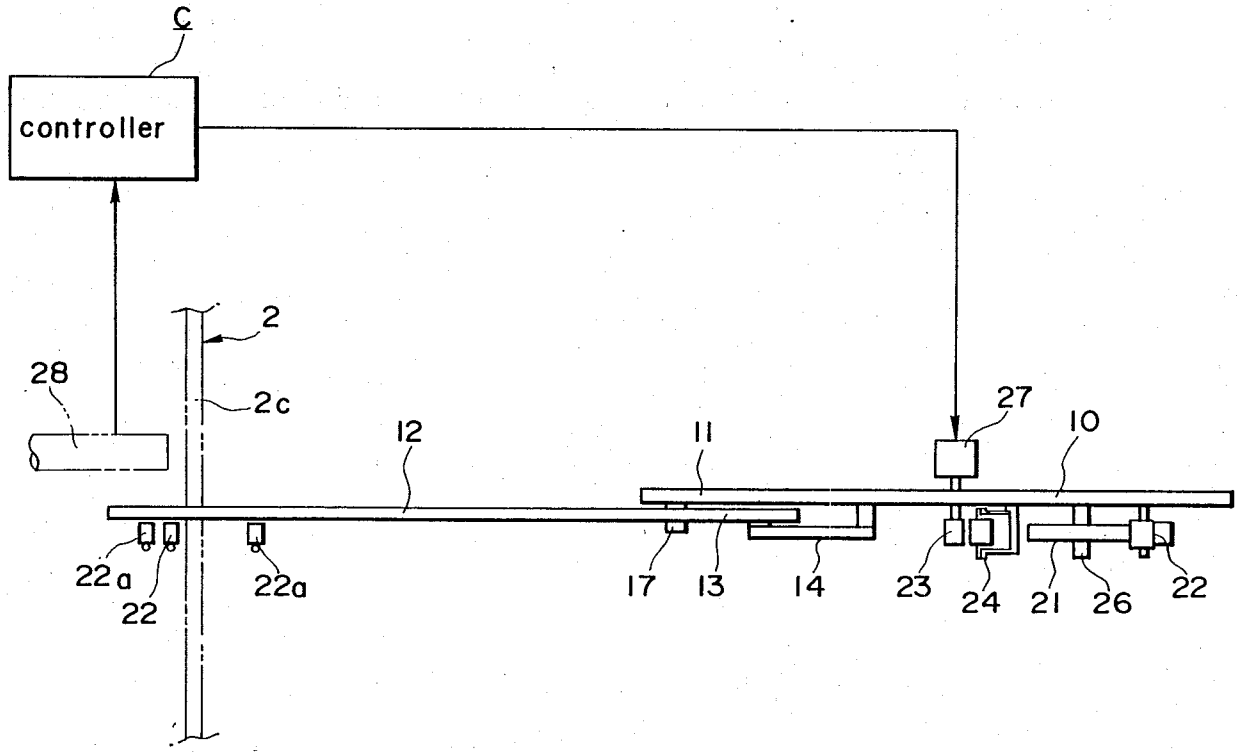
FIG. 3 is a diagrammatic plan view of the apparatus shown in FIG. 2.

FIGS. 2 and 3 show an embodiment of a dressing apparatus in accordance with the present invention which comprises a body 10.

The body 10 comprises a plate-like member having a predetermined thickness. A head 12 in the form of a rectangular plate is mounted on a tip portion 11 of the body 10, which is located at a left upper portion thereof as viewed in FIG. 2, through a pair of parallel links 14 and 14 so as to be movable up and down along a surface of the body 10, as indicated by an arrow B in FIG. 2. A spring 15 is disposed between the body 10 and an upper portion of a base 13 of the head 12 for biasing the same upwardly (FIG. 2). An air cylinder actuator 16 is mounted on the body 10 at a location above the base 13 of the head 12 for moving the same downwardly against the biasing force of the spring 15, the actuation of the air cylinder being electrically controlled. On the other hand, a stopper 17 is provided on the body 10 at a location below the base 13 of the head 12 for restricting the downward movement of the head 12 by the actuator 16 at a predetermined position. The head 12 has a tip having formed therein a cut-out 18 which opens downwardly.

A tape traveling device 20 for a tape 19 is disposed on the body 10 and the head 12. The tape traveling device 20 comprises a feed bobbin 21 having wound therearound the tape 19, a plurality of guide rollers 22, 22*a* for guiding the tape 19, a capstan 23 for causing the tape 19 to travel, pinch rollers 24 and 24 for applying a constant tension to the tape 19 under traveling, and a take-up bobbin 25 for taking up the tape 19. The feed bobbin 21 is rotatably mounted on a lower portion of the body 10 through a shaft 26, and the guide rollers 22, 22*a* are disposed at appropriate locations on the body 10 and the head 12 in such a manner that the guide rollers 22, 22*a* once guide the tape 19 fed out of the feed bobbin 21, to the cut-out 18 in the tip of the head 12 and, subsequently, again guide the tape 19 to the lower end portion of the body 10. The body 10 has rotatably mounted on the lower portion thereof the capstan 23 for causing the tape 19 to travel along the guide rollers 22, 22*a* and the take-up bobbin 25 for taking up the tape 19 fed from the capstan 23. The body 10 also has mounted on the opposite surface thereof a motor 27 for directing rotatingly driving the capstan 23 and for rotatingly driving the take-up bobbin 25 in interlocked relation to the rotation of the capstan 23. The pinch rollers 24 and 24 for imparting a predetermined tension to the traveling tape 19 are disposed at a location of the capstan 23 in a front stage of the take-up bobbin 25 and at a location in a rear stage of the feed bobbin 21, respectively.

The tape 19 driven and guided by the traveling device 20 is flexible and takes the form of a film which has a side having formed thereon an abrasive grain layer consisting of abrasive grain such as silicon carbide or the like. Such tape is commercially available, for example, as "Imperial" from the 3M. The tape 19 is guided by the guide rollers 22*a* and 22*a* of the traveling device 20, which are respectively located in front and rear of the cut-out 18 in the head 12 such that the tape 19 extends across the cut-out 18 so as to be inclined with respect to an end face 2*c* of the inner peripheral cutting edge 2 inserted into the cut-out 18. In FIGS. 2 and 3, the reference numeral 28 designates a displacement or run-out detecting sensor such as an eddy-current displacement sensor or the like which is disposed closely adjacent the inner peripheral cutting edge 2 of the cut-off wheel W which is mounted on a cutting machine (not shown) and is rotated thereby at a high speed, for detecting a displacement or run-out of the inner peripheral cutting edge 2.

An embodiment of a dressing method in accordance with the present invention which utilizes the dressing apparatus arranged as described above will be described hereunder.

Figure 1:
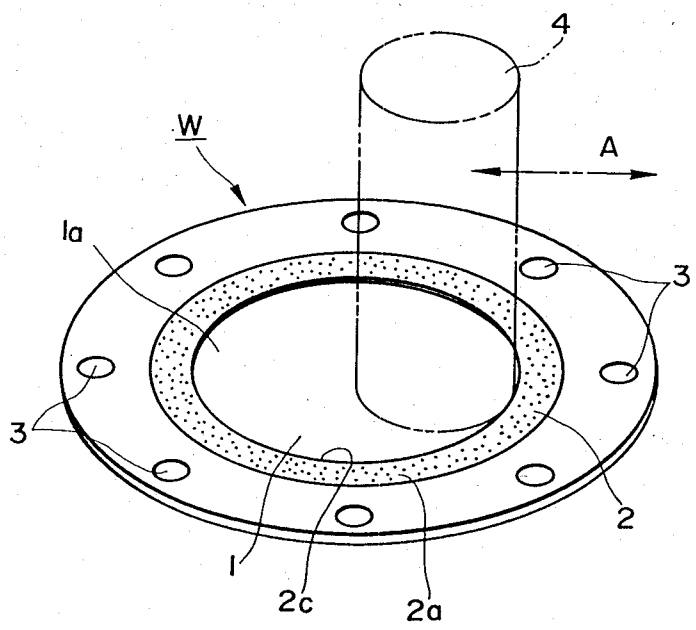
FIG. 1 is a perspective view of showing a cut-off wheel W having an inner peripheral cutting edge 2.

At the outset, the head 12 of the dressing apparatus is inserted in the vicinity of a location 1a diametrically opposite to the silicon ingot 4, in the opening 1 of the cut-off wheel W which is cutting the silicon ingot 4, as shown in FIG. 1. Then, the body 10 is fixed, by an appropriate fixing means, to a body (not shown) of the cutting machine at a position where the cut-out 18 in the head 12 faces to the end face 2*a* of the inner peripheral cutting edge 2 of the cut-off wheel W.

In parallel with the above, the displacement detecting sensor 28 measures a displacement amount of one side surface (left side surface as viewed in FIGS. 2 and 3) of the inner peripheral cutting edge 2 which is cutting the silicon ingot 4, to supply a signal representative of the measured displacement of the surface 2*a* to a controller C comprising, for example, a microprocessor. Then, the controller C compares the measured displacement with a preset value to determine a required dressing time. The required dressing time can easily be calculated, in a conventional manner, from data previously obtained through experiments and stored in the controller C.

Figure 4:
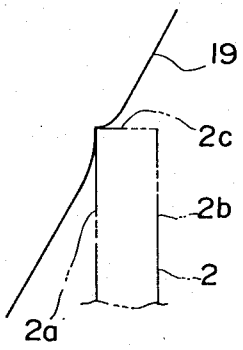
FIG. 4 is an illustration showing the positional relation between the tape 19 and the cutting edge 2.

Subsequently, the motor 27 is driven by the controller C to cause the tape 19 to travel from the feed bobbin 21 toward the take-up bobbin 25, as indicated by arrows in FIG. 2. In parallel with this, the signal from the controller C causes the air cylinder actuator 16 to be driven for the time calculated as above the press and head 12 downwardly to allow the tape 19 within the cut-out 18 to be urged against the side surface 2*a* of the inner peripheral cutting edge 2 which is left with respect to the end face 2*a* thereof, to thereby apply the dressing thereto. In this case, the abrasive side of the tape 19 is brought into contact with both of the side surface 2*a* and the end surface 2*c* of the cutting edge 2, as shown in FIG. 4. Subsequently, when the calculated dressing time elapses, the energization of the air cylinder actuator 16 is halted and the motor 27 is stopped in response to the signal from the controller C. This allows the head 12 to be displaced upwardly under the biasing force of the spring 15 to move the tape 19 away from the end face 2*a* of the inner peripheral cutting edge 2. Thus, the dressing of the left side surface 2*a* is completed.

Subsequently, the guide rollers 22*a* and 22*a* respectively located in front and rear of the cut-out 18 in the head 12 are removed from the head 12 and are again attached thereto by, for example, screwing the shafts of the guide rollers 22*a* and 22*a* into threaded holes 42 and 42 formed in the head 12, so as to be located in inverse upper and lower positional relation, so that the tape 19 extending across the cut-out 18 is inversely inclined. Alternatively, the head 12 may be inserted into the opening 1*a* from the opposite side of the cutting wheel W. Thus, the dressing is applied to the right side surface 2*b* of the inner peripheral cutting edge 2 in a manner similar to that described above.

According to such dressing method utilizing the aforesaid dressing apparatus, it is possible to suitably apply a dressing to the inner peripheral cutting edge 2, while cutting the silicon ingot 4 which is the work piece to be cut. Consequently, it is possible to continuously obtain products which is low in warp and uniform in thickness, and the dressing does not interfere with the cutting operation, so that it is possible to considerably enhance the operating efficiency. In addition, since it is possible to apply the dressing to each of the side surfaces 2*a* and 2*b* of the inner peripheral cutting edge 2 by the inclination of the tape 19 with respect to the end face 2*c* of the inner peripheral cutting edge 2, it is possible to apply the dressing only to a required one of the side surfaces 2*a* and 2*b*. Accordingly, it is possible to avoid an excessive dressing, and it is possible to prolong the service life of the inner peripheral cutting edge 2.

Figure 5:
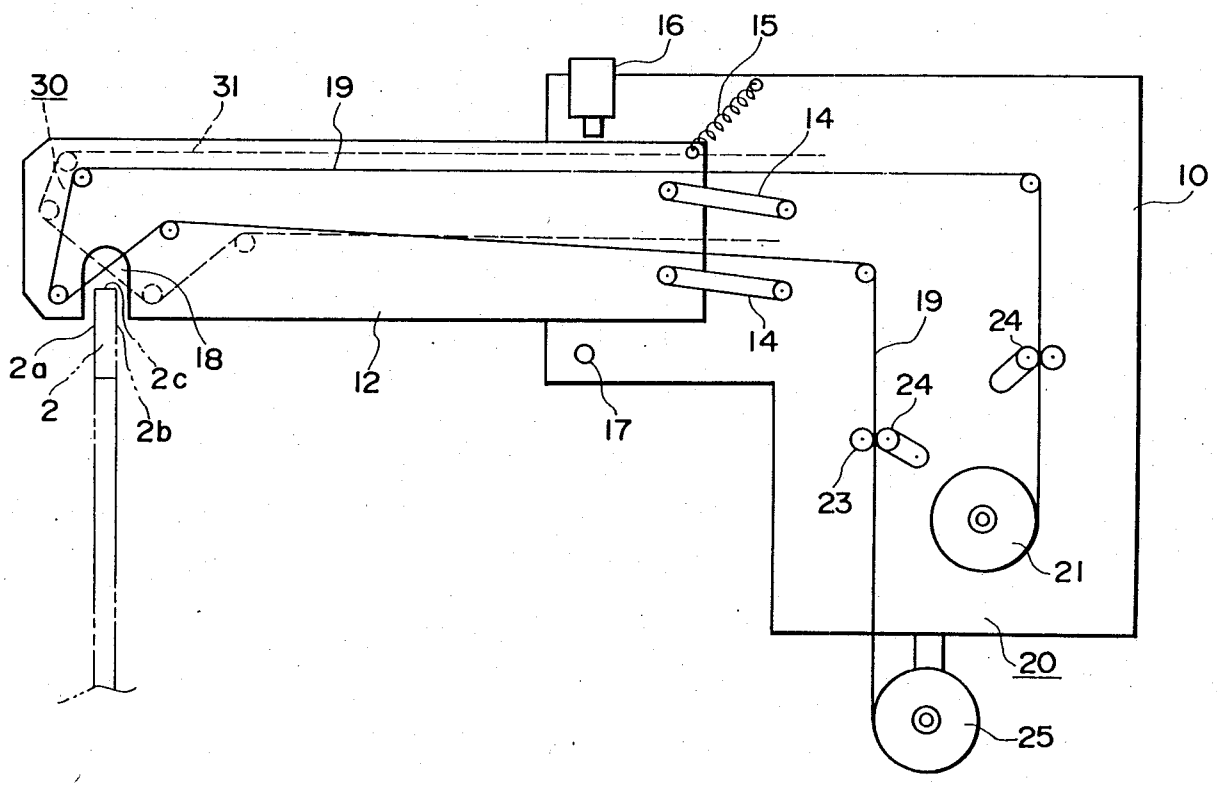
FIG. 5 is a diagrammatical front elevational view showing another embodiment of the present invention.

FIG. 5 shows another embodiment of the present invention. A dressing apparatus in accordance with the another embodiment is arranged such that, in addition to the tape traveling device 20, a similar tape traveling device 30 is provided on the opposite side of the body 10 and the head 12 as shown by the broken line in FIG. 5. The traveling means 30 allows a tape 31 similar to the tape 19 to be guided so as to extend across the cut-out 18 in the head 12 in the direction crossing the tape 19, i. e., in the direction which applies the dressing to the right side surface 2*b*, as viewed in FIG. 5, of the inner peripheral cutting edge 2 inserted into the cut-out 18.

In operation, the tapes 19 and 31 are selectively or simultaneously driven and brought into contact with the cutting edge 2.

With the dressing apparatus illustrated in FIG. 5, it is possible to expect to have functional advantages similar to those obtained by the dressing apparatus shown in FIGS. 2 and 3. Further, should one or both of the traveling devices 20 and 30 be suitably driven, it would be possible to freely apply the dressing to one or both of the side surfaces 2*a* and 2*b* of the inner peripheral cutting edge 2 with a single apparatus.

Although the embodiment have been described and illustrated as applying to dressing to the inner peripheral cutting edge 2, the present invention should not be limited to such embodiments, but can obtain similar functional advantages when applied to a cutting wheel having an outer peripheral cutting edge.

As described above, the dressing apparatus in accordance with the present invention comprises a head movably mounted on a tip portion of a body, the head having a tip having formed therein a cut-out which opens in the direction of the movement of the head and into which an outer or an inner peripheral cutting edge of a cut-off wheel in the form of a disc is adapted to be inserted, tape traveling means mounted on the head and the body for causing a tape having a layer of abrasive grain on a side thereof, to travel across the cut-out in the head, and actuator means disposed between the head and the body for moving the head. The dressing apparatus and the dressing method in accordance with the present invention are arranged such that the outer or inner peripheral cutting edge is inserted in the cut-out in the head, and the outer or inner peripheral cutting edge and the side of the tape having thereon the abrasive grain layer are brought into contact with each other while causing the tape to travel, to apply a dressing to the outer or inner peripheral cutting edge. With such arrangement of the present invention, it is possible to apply the dressing to the outer or inner peripheral cutting edge in parallel with the cutting of a work piece to be cut and, accordingly, it is possible to continuously obtain products which are low in warp and uniform in thickness. Moreover, it is possible to increase the operation efficiently, and it is possible to prolong the service life of the outer or inner peripheral cutting edge. Furthermore, since a long tape can be wound around a bobbin, it is possible to continue an automatic cutting operation over a great number of cycles without the necessity of the replacement of the dressing material.

What is claimed is:

1. An apparatus for applying a dressing to a peripheral cutting edge of abrasive grain formed on either an outer periphery or an inner periphery of a disc-shaped cut-off wheel mounted on a cutting machine so as to be rotated at a predetermined speed for cutting a semiconductor material, said peripheral cutting edge having a peripheral surface and a pair of opposite side surfaces disposed adjacent to said peripheral surface, comprising:

a plate-like body having a first and second sides opposite to each other, said body being mounted on said cutting machine;

a head having first and second sides opposite to each other, said head being movably mounted on said body in such a manner that the first side of the body faces the second side of the head, said head having a proximate end secured to said body and a distal end, said head being disposed generally perpendicularly to a plane in which the cut-off wheel lies, said head having formed therein adjacent the distal end thereof a cut-out in which said peripheral cutting edge of the cut-off wheel is receivable;

a flexible tape having a layer of abrasive grain on a side thereof, said tape being mounted on the first sides of said head and body so as to be capable of being transported along a path;

tape travelling means mounted on said head and said body for causing said tape to travel along the path including across said cut-out in said head so as to be inclined with respect to the peripheral surface of the peripheral cutting edge; and actuator means mounted on the body and operatively connected to said head for moving said head relative to the peripheral cutting edge of the cut-off wheel so that the side of said tape is movable into contact with the peripheral surface and one of the side surfaces of the peripheral cutting edge of the cut-off wheel during rotation of the wheel to apply a dressing to the peripheral surface and the one side surface of the peripheral cutting edge of the cut-off wheel during rotation of the wheel.

2. A dressing apparatus ad defined in claim 1 further comprising:

a second flexible tape having a layer of abrasive grain on a side thereof, said second tape being mounted on the second sides of said head and body so as to be capable of being transported along a path; and second tape traveling means mounted on said head and said body for causing said tape to travel along the path including across said cut-out in said head so as to be inclined with respect to the peripheral surface of said peripheral cutting edge in the direction opposite to that in which the first-mentioned tape is inclined;

said actuator means being operatively connected to said head for moving said head relative to the peripheral cutting edge of the cut-off wheel so that the side of the second tape is brought into contact with the peripheral surface and the other of the side surfaces of the peripheral cutting edge of the cut-off wheel during rotation of the wheel to apply a dressing to the peripheral surface and the other side surface of the peripheral cutting edge of the cut-off wheel during rotation of the wheel.

3. A dressing apparatus as defined in claim 2, further comprising:

sensing means for detecting a displacement of the peripheral cutting edge of the cut-off wheel during rotation thereof to produce a sensing signal; and control means responsive to said signal to select one side surface to be dressed from the opposite side surfaces of the peripheral cutting edge to operate said actuator means and one of said first-mentioned tape traveling means and said second tape traveling means for applying a dressing to the peripheral surface and the selected side surface of the peripheral cutting edge during rotation of the cut-off wheel.

4. A dressing apparatus as defined in claim 3, wherein said actuator means includes stopper means for positioning said head in place.

* * * * *